US006446267B1

(12) United States Patent
Shah

(10) Patent No.: US 6,446,267 B1
(45) Date of Patent: Sep. 10, 2002

(54) PROTECTIVE SOCK AND SHOE LINING

(76) Inventor: Mrugesh K. Shah, 403 Trails Ct., Houston, TX (US) 77024

( * ) Notice: Subject to any disclaimer, the term of this patent is extended or adjusted under 35 U.S.C. 154(b) by 0 days.

(21) Appl. No.: 09/963,437

(22) Filed: Sep. 27, 2001

(51) Int. Cl.[7] ..... A41B 11/00
(52) U.S. Cl. ..... 2/239
(58) Field of Search ..... 2/239, 240, 241, 2/242, 455; D2/903, 919, 920, 923, 924, 933, 980, 981, 983

(56) References Cited

U.S. PATENT DOCUMENTS 3,760,056 A * 9/1973 Rudy ..... 264/230
4,194,249 A * 3/1980 Thorneburg ..... 2/239
5,042,175 A * 8/1991 Ronen et al. ..... 36/15
5,067,257 A * 11/1991 Coomer ..... 36/117.6
5,329,640 A * 7/1994 Hourigan ..... 2/239
5,392,534 A * 2/1995 Grim ..... 36/154
5,430,896 A * 7/1995 Bisley ..... 2/239
5,532,039 A * 7/1996 Payne et al. ..... 428/116
5,575,090 A * 11/1996 Condini ..... 36/54
5,596,770 A * 1/1997 Kunesh ..... 2/239
5,647,149 A * 7/1997 Dalebout ..... 36/10
6,047,434 A * 4/2000 Falwell ..... 2/239
6,275,997 B1 * 8/2001 Richardson ..... 2/239

* cited by examiner

*Primary Examiner*—Danny Worrell
*Assistant Examiner*—Gary L. Welch
(74) *Attorney, Agent, or Firm*—Harrison & Egbert

(57) ABSTRACT

A sock for a human foot including an outer layer having a shape generally conforming to a shape of the human foot, a resilient member layer positioned adjacent to the outer layer and extending around an interior of the outer layer, a packing layer positioned adjacent to the resilient member layer and extending around an exterior of the resilient member layer, and a deformable member affixed to the packing layer. The deformable member conforms to a contour of the human foot upon pressure supplied by a surface of the human foot in an area of the contour. The outer layer is a fibrous material. The resilient member layer is a plurality of springs. The packing layer is either a bubble wrap material or a plurality of foam elements. The deformable member is a silicone pad affixed to an interior surface of the packing layer.

13 Claims, 3 Drawing Sheets

PROTECTIVE SOCK AND SHOE LINING

BACKGROUND OF THE INVENTION

1. Field of the Invention

The present invention relates to sock and shoe linings. More particularly, the present invention relates to socks and shoe linings which will absorb shock and pressures applied thereto during human activity. Furthermore, the present invention relates to socks and shoe linings which will provide a suitable jog of movement upon application of pressures thereto.

2. Description of Related Art

As is well known, the feet, particularly the soles of the feet, carry the entire body weight. The many shoe sole constructions found on the market absorb only a small portion of the shock caused as the shoe contacts the floor. Shocks which are not absorbed can cause damage to the body. This occurs in the soles of the feet, which have many bones and many jointed surfaces, and in the knees which have fine meniscus stabilizing the joint and permitting smooth movement. The spinal cord is built for many vertebrae, with disks between them which are very sensitive to changes, and which permit bending and straightening of the body.

Over a long period of athletic activity, the beating and shock imparted to the feet may cause stress fractures in the leg. Also, the shocks cause changes in the structure of the vertebrae, affecting the disks between them, by making them thin and irregular due to friction, so that they lose their flexibility. The damage causes limited movement and flexibility for the entire length of the spinal cord, leading to neck and shoulder pain, poor blood circulation and stability problems.

The affects of the damage to the disks are felt frequently in back pain, along with a tendency for increased fatigue, and over time the growth of bone fibers is expected in the area around the vertebrae. Sometimes, this brings about a split in the disk as it explodes under the pressure to its soft center. Damage to the disks of the vertebrae can also cause distortion and straightness of the back which brings about pressure on nerves and may cause a neurological block leading to paralysis. In addition, problems including headaches, dizziness and deadening of the senses cause major day-to-day discomforts.

During athletic activity, such as during the play of football, great pressures and stresses are applied by the knees and the feet. When the structures associated with the shoe do not overcome the pressures applied to the knee, knee damage can occur. Ultimately, the strong torque applied by the feet to the earth and upon the knees can cause inherent and longer term damage to the knee structure. As such, there is a need to provide an improved system of shock absorption which is user specific and preserves the maximum amount of energy accumulation during compression of material from which the sole or sock is constructed, reducing wastage by friction or heat and enabling maximum energy to be returned after compression.

In the past, various patents have issued relating to such shoe and sock constructions. For example, U.S. Pat. No. 3,760,056, issued on Dec. 18, 1973 to M. F. Rudy, describes a method of custom fitting an inflatable bladder to a wearer's foot. The inflatable bladder is made of a suitable elastomer which may be heated, distended and then cooled at room temperature to set the bladder in the distended shape. The bladder will custom fit to the wearer's foot.

U.S. Pat. No. 3,765,422, issued on Oct. 16, 1973 to H. M. Smith, describes a fluid cushioned podiatrac insole. This insole is in the form of a flat flexible envelope in the outline of a wearer's foot. The envelope contains a liquid or semi-liquid flowable cushioning medium. A transverse wall divides the interior of the insole into front and rear chambers. The transverse wall extends along the forward edge of the metatarsal pressure points of the foot of the wearer. The rear chamber has longitudinal walls directing the flowable medium forwardly and rearwardly in such chamber.

U.S. Pat. No. 5,067,257, issued on Nov. 26, 1991 to S. Coomer, describes an injection fitted boot liner which is fitted by low pressure fluid injection over the wearer's anatomy. This liner is formed by permeation of select areas of porous padding, surrounding areas of non-porous padding and with scarfed abutment of padding for gradual softness variation. An impervious membrane occluding portions of the porous padding is used to control fluid resin penetration.

U.S. Pat. No. 5,392,534, issued on Feb. 28, 1995 to T. E. Grim, teaches a vacuum formed comfortable sole which uses vacuum formable bladders in the sole of the shoes or in the sides of the upper portions of the shoes. The bladders are filled with material, such as small spherical particles, which retain a configuration conforming to the shape of the feet under reduced pressure conditions.

U.S. Pat. No. 5,042,175, issued on Aug. 27, 1991 to Rowen et al., teaches a user-specific shoe sole coil spring system having a layout of individual coil springs which are seated in a shoe sole having prefabricated circular depressions. The coil spring system has stiffness characteristics which are customized to serve the needs of different users and different applications. The system provides shock absorption distribution patterns and energy return patterns for the shoe sole to fit the requirements of the particular application. The sole has a cover strip overlaying the coil spring system which is openable and reclosable for allowing changes in the layout, as required.

U.S. Pat. No. 5,575,090, issued on Nov. 19, 1996 to A. Condini, teaches an inner boot tongue of a ski boot which has an outer part formed of an impermeable semi-rigid plastic having an alveolate structure and which is covered directly by a foam-type padding and by a woven or knitted liner. The air contained in the alveoles of the alveolate structure forms a particularly effective damper cushion in dynamic compression.

U.S. Pat. No. 5,647,149, issued on Jul. 15, 1997 to M. W. Dalebout, describes a sport boot system incorporating a pliable inner liner within a rigid outer shell. The inner liner is of a foam material and is provided with a single bifurcation at its outer side to provide a tongueless entry access opening. Relief structures are positioned at the front of the liner to provide enhanced forward flexibility and to increase comfort.

It is an object of the present invention to provide a sock which has maximum shock-absorption characteristics.

It is a further object of the present invention to provide a sock which provides suitable "give" so as to prevent damaging torques from adversely affecting the knee and back structure of the human body.

It is a further object of the present invention to provide a sock and/or shoe liner which cushions against shocks and impacts occurring during normal walking or running activity.

It is still a further object of the present invention to provide a sock and/or shoe linings system which are comfortable and easy to use.

These and other objects and advantages of the present invention will become apparent from a reading of the attached specification and appended claims.

BRIEF SUMMARY OF THE INVENTION

The present invention is a sock for a human foot which comprises an outer layer having a shape generally conforming to the shape of the human foot, a resilient member layer positioned adjacent to the outer layer and extending around an interior of the outer layer, a packing layer positioned adjacent to the resilient member layer and extending around an interior of the resilient member layer, and a deformable member means affixed to the packing layer. The deformable member means serves to conform to a contour of the human foot upon the application of pressure by the human foot.

In the present invention, the outer layer is a fibrous material, such as cotton. The outer layer could also be the surface of an interior of a shoe. The outer layer can be permanently affixed to the interior of the shoe.

The resilient member layer comprises a plurality of springs. Each of the springs has one end secured to the outer layer and an opposite end secured to the packing layer. The plurality of springs extend entirely around the packing layer. A flexible structure is interposed between the packing layer and the resilient member layer. The plurality of springs are each secured to the flexible structure. This flexible structure can be formed of a fibrous material, such as cotton.

The packing layer comprises either a bubble wrap material or a foam material which extends around the interior surface of the resilient member layer. The foam material can be a plurality of foam elements arranged in a random pattern around the interior surface of the resilient member layer.

The deformable member means includes a plurality of silicone pads which are affixed to an interior surface of the packing layer. Specifically, the plurality of pads includes a first pad affixed to an interior surface of the packing layer corresponding to the sole of a human foot, a second pad corresponding to a side of the human foot and a third pad corresponding to an opposite side of the human foot.

In the present invention, an inner layer can be affixed to the deformable member means and to the packing layer. This inner layer extends around the deformable member means and around the packing layer so as to define a cavity for receiving the human foot therein. This inner layer can be of a fibrous material, such as cotton.

The present invention is also a shoe liner which comprises a shoe having an interior surface, a resilient member layer affixed to the interior surface, a packing layer affixed to an interior of the resilient member layer, and a deformable member means affixed to an interior surface of the packing layer. The resilient member layer comprises a plurality of springs each having one end secured to the interior surface of the shoe. The packing layer can be either a bubble wrap material or a foam material. The bubble wrap material or the foam material will extend around an interior surface of the resilient member layer. The deformable member means includes a plurality of silicone pads which are affixed to an interior surface of the packing layer so as to conform to the particular contours of the human foot.

DETAILED DESCRIPTION OF THE INVENTION

Figure 1:
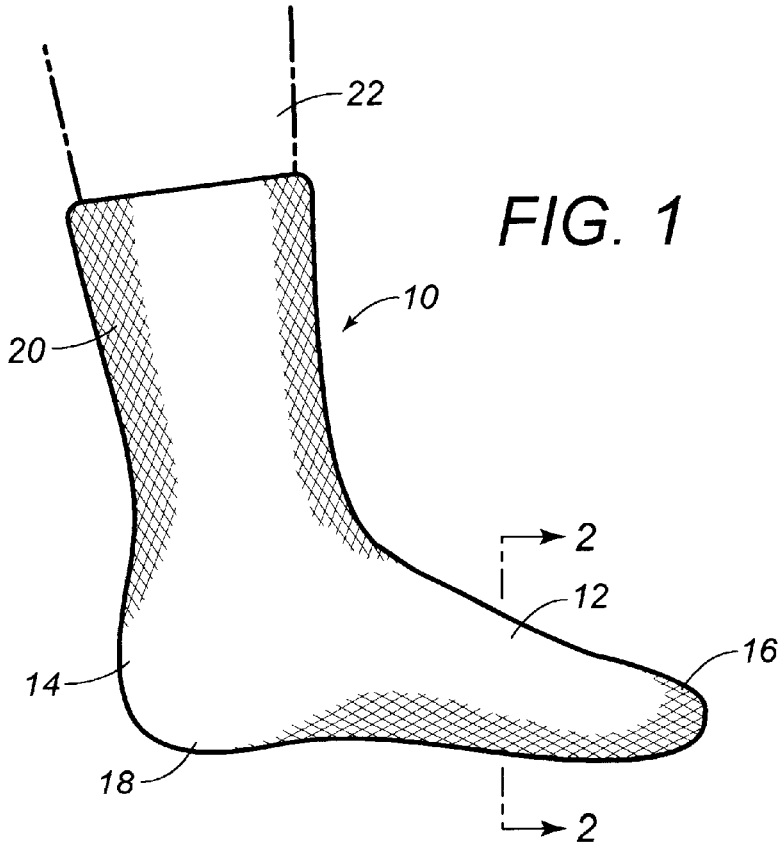
FIG. 1 is a side elevational view showing the sock of the present invention as applied to a human foot.

Referring to FIG. 1, there is shown at the sock 10 of the present invention as applied to a human foot 12. Sock 10 is illustrated as having an outer layer 14 generally conforming to the shape of the human foot 12. The sock 10 includes a toe portion 16, a heel portion 18 and an ankle portion 20. The sock 10 of the present invention has an interior cavity suitable for receiving the human foot 12 therein. Leg 22 will extend upwardly and outwardly of the sock 10. As shown in FIG. 1, the sock 10 of the present invention will be attached to the human foot in the manner of a conventional sock.

Figure 2:
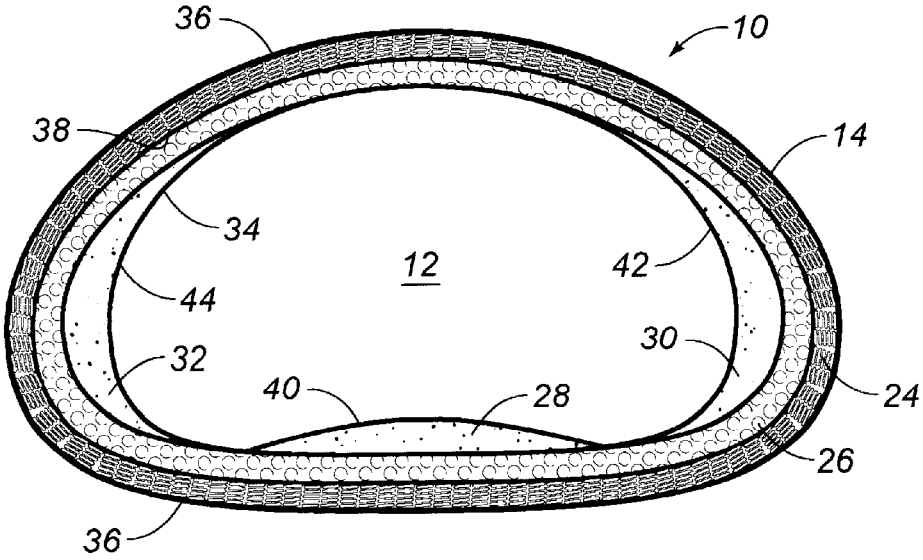
FIG. 2 is a cross-sectional view as taken across lines 2—2 of FIG. 1.

FIG. 2 shows a cross-sectional view of the sock 10 of the present invention. In FIG. 2, it can be seen that the outer layer 14 has a generally oval shape and generally conforms to the cross-sectional shape of the human foot 12. A resilient member layer 24 is positioned adjacent to the outer layer 14 and extends around an interior of the outer layer 14. A packing layer 26 is positioned adjacent to the resilient material layer 24 and extends around an interior of such resilient material layer 24. Deformable members 28,30 and 32 are affixed to interior surfaces of the packing layer 26. Deformable members 28, 30 and 32 are positioned so as to be placed directly adjacent to the outer surface of the foot 12. If necessary, an inner layer 34 can extend around the deformable members 28, 30 and 32 against the packing layer 26 and directly against the outer surface of the human foot 12.

Figure 4:
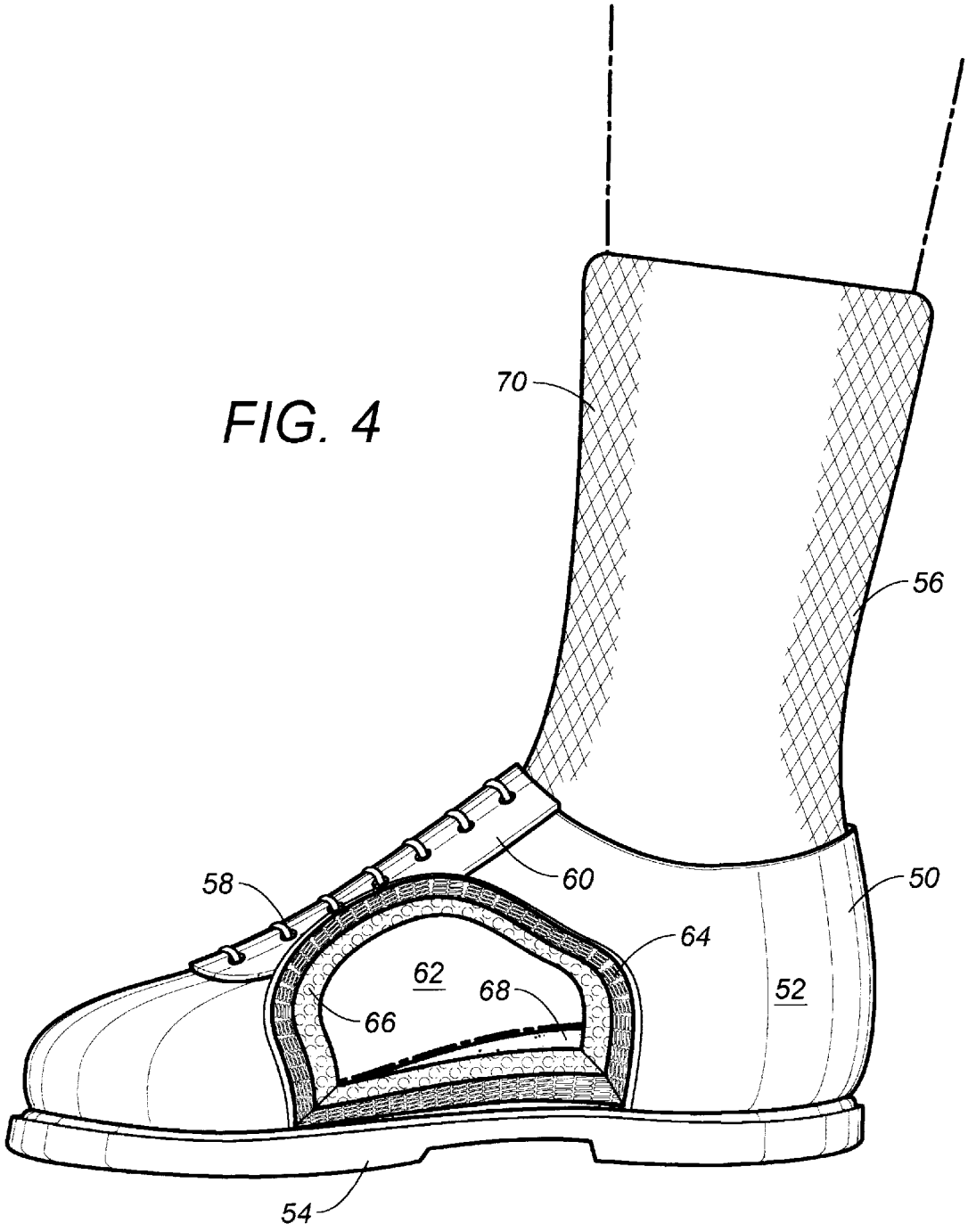
FIG. 4 is a cut-away view showing the present invention acting as a shoe lining.

As can be seen herein, the outer layer 14 is formed of a fibrous material, such as cotton. In another alternative embodiment of the present invention (as shown in FIG. 4), the outer layer can actually be the interior surface of a shoe.

The resilient member layer comprises a plurality of springs 36 each having one end secured to the outer layer 14 and an opposite end secured to the packing layer 26. These plurality of springs 36 extend entirely around the packing layer 26. A flexible structure 38 may be provided between the packing layer 26 and the resilient member layer 24 so as to provide a structure whereby each of the springs 36 can be directly secured thereto. Each of the springs 36 has a longitudinal axis which extends transverse to the longitudinal axis of the foot 12. When forces are applied by the foot 12 upon the resilient member layer 24, each of the springs will extend and/or compress depending on the amount of force that is applied by the foot 12 to an interior surface of the shoe in which the sock 10 is received.

The packing layer 26 is shown as either being a bubble wrap material or a foam material. The packing layer 26 extends around the interior surface of the resilient member layer 24. When a foam material is used, the packing layer 26 can be a plurality of foam elements arranged in a random pattern around the interior surface of the resilient member layer 24.

The deformable members 28, 30 and 32 are a plurality of silicone pads affixed to the interior surface of the packing layer 26. First pad 28 is affixed to the interior surface of the packing layer 26 in an area corresponding to the sole 40 of the human foot 12. A second pad 30 is affixed to the packing layer 26 in an area corresponding to one side 42 of the human foot 12. Finally, a third pad 32 is affixed to an inner surface of the packing layer 26 in an area corresponding to an opposite side 44 of the human foot 12. The silicone pads 28, 30 and 32 are suitably deformable so as to provide a more gradual conforming of the sock (and shoe thereover) to the contours of the human foot. As such, the present invention provides a sock and/or shoe lining which will suitably "conform" to the contours of the human foot. Within the concept of the present invention, various silicone pads 28, 30 and 32 can be placed in the position shown in FIG. 2 and throughout the interior surface of the sock 10.

Figure 3:
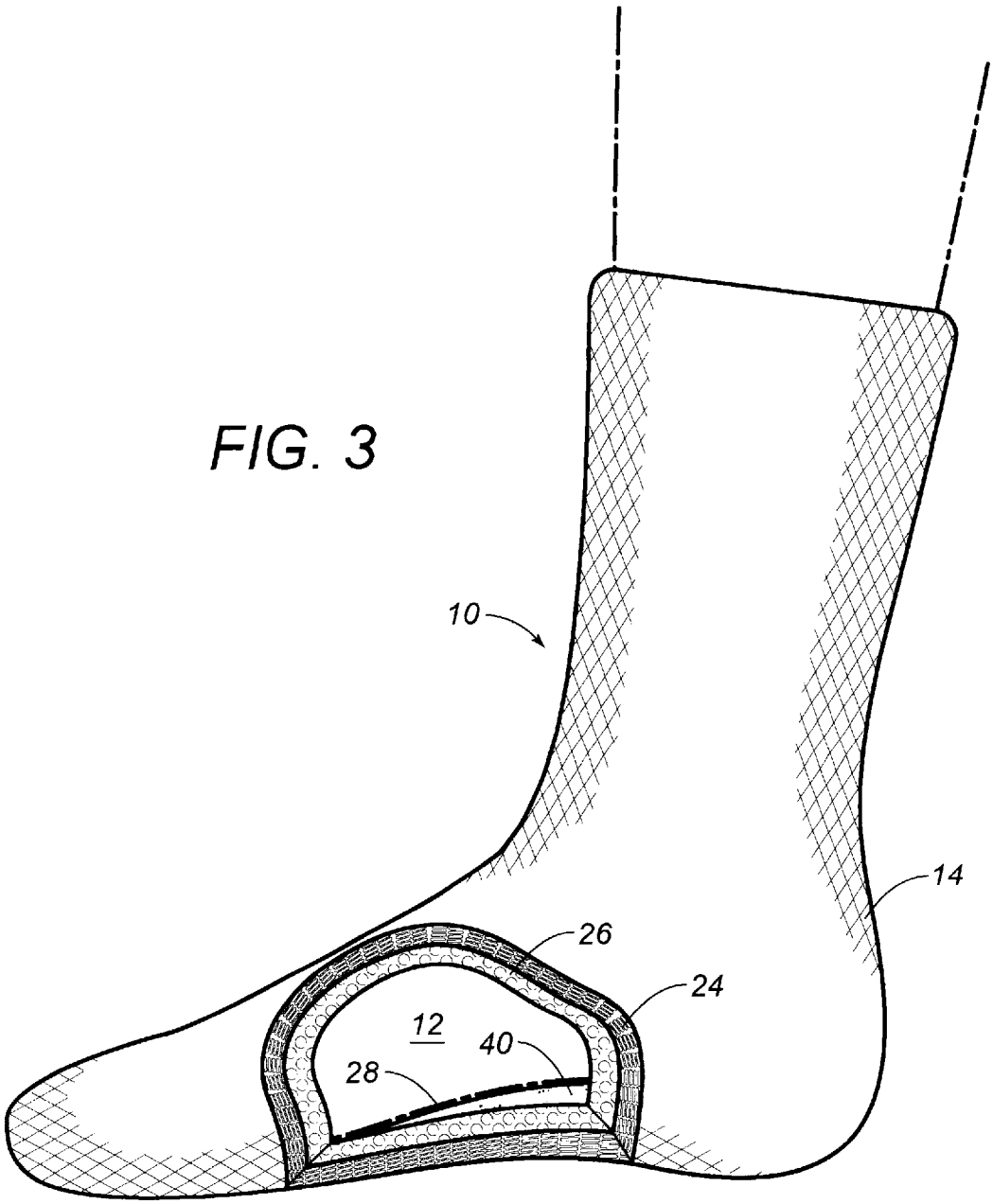
FIG. 3 is a partial cut-away view of the sock of the present invention as applied to a human foot.

FIG. 3 shows a cut-away view of the sock 10 with the human foot 12 illustrated therein. It can be seen that the outer layer 14 will extend around the human foot 12. Resilient member layer 24 is positioned interior of the outer layer 14. Similarly, packing layer 26 is positioned interior of the resilient member layer 24. It can be seen that the silicone pad 28 is positioned below the sole 40 of the foot 12.

FIG. 4 shows the application of the present invention in the form of a liner of a shoe 50. Shoe 50 has an upper 52 and a sole 54. The shoe 50 is applied around a conventional sock 56 (or a sock in accordance with the teachings of the preferred embodiment of the present invention). Lacings 58 serve to properly secure the tongue 60 in a desired position over the top of the human foot 62.

In FIG. 4, it can be seen that the resilient member layer 64 is secured to the interior surface of the upper 52 of shoe 50. The resilient member layer 64 will also extend over the interior surface of the sole 54 of shoe 50. The packing layer 66 will extend around the interior of the resilient member layer 64. The packing material layer 66 resides against the surface of the human foot 62. Resilient pad 68 is affixed to an interior surface of the packing 66 and will reside against the sole of the human foot 62. Ankle portion 70 can be the interior lining of the embodiment of the present invention shown in FIG. 4 extending outwardly of the interior of the shoe 50 or it can be a separate sock element which is placed over the human foot and placed on the interior of the shoe 50.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A sock for a human foot comprising:

an outer layer having a shape generally conforming to a shape of the human foot;

a resilient member layer positioned adjacent said outer layer and extending around an interior of said outer layer, said resilient member layer comprising a plurality of springs each having one end secured to said outer layer;

a packing layer positioned adjacent to said resilient member layer and extending around an interior of said resilient member layer, said plurality of springs extending entirely around said packing layer; and a deformable member means affixed to said packing layer opposite said resilient member layer, said deformable member means for conforming to a contour of the human foot upon pressure applied by a surface of the human foot in an area of the contour.

2. The sock of claim 1, said outer layer being of a fibrous material.

3. The sock of claim 2, said outer layer being of a cotton material.

4. The sock of claim 1, said outer layer being a surface on an interior of a shoe.

5. The sock of claim 4, said outer layer being affixed permanently to said interior of said shoe.

6. The sock of claim 1, further comprising:

flexible structure interposed between said packing layer and said resilient member layer, said plurality of springs each having an opposite end secured to said flexible structure.

7. The sock of claim 6, said flexible structure being formed of a fibrous material.

8. The sock of claim 1, further comprising:

an inner layer affixed to said deformable member means and to said packing layer, said inner layer being of a fibrous material, said inner layer defining a cavity for receiving the human foot therein.

9. A sock for a human foot comprising:

an outer layer having a shape generally conforming to a shape of the human foot;

a resilient member layer positioned adjacent said outer layer and extending around an interior of said outer layer, said resilient member layer comprising a plurality of springs each having one end secured to said outer layer;

a packing layer positioned adjacent to said resilient member layer and extending around an interior of said resilient member layer, said packing layer comprised of a bubble wrap material extending around said interior of said resilient member layer; and a deformable member means affixed to said packing layer opposite said resilient member layer, said deformable member means for conforming to a contour of the human foot upon pressure applied by a surface of the human foot in an area of the contour.

10. A sock for a human foot comprising:

an outer layer having a shape generally conforming to a shape of the human foot;

a resilient member layer positioned adjacent said outer layer and extending around an interior of said outer layer, said resilient member layer comprising a plurality of springs each having one end secured to said outer layer;

a packing layer positioned adjacent to said resilient member layer and extending around an interior of said resilient member layer, said packing layer comprising a foam material extending around said interior of said resilient member layer; and a deformable member means affixed to said packing layer opposite said resilient member layer, said deformable member means for conforming to a contour of the human foot upon pressure applied by a surface of the human foot in an area of the contour.

11. The sock of claim 10, said foam material being a plurality of foam elements arranged in a random pattern around said interior of said resilient member layer.

12. The sock of claim 10, said deformable member means comprising:

a plurality of silicone pads affixed to an interior surface of said packing layer.

13. The sock of claim 12, said plurality of silicone pads comprising:

a first pad affixed to an interior surface of said packing layer corresponding to a sole of the human foot;

a second pad affixed to said interior surface of said packing layer corresponding to one side of the human foot; and a third pad affixed to said interior surface of said packing layer and corresponding to an opposite side of the human foot.

* * * * *